United States Patent [19]

Segal

[11] Patent Number: 4,789,064

[45] Date of Patent: Dec. 6, 1988

[54] RETAINER CLIP FOR UTENSILS

[76] Inventor: Paul Segal, 15 Colonial Rd., White Plains, N.Y. 10605

[21] Appl. No.: 100,410

[22] Filed: Sep. 24, 1987

[51] Int. Cl.[4] ..... B65D 73/00

[52] U.S. Cl. ..... 206/493; 206/478; 229/1.5 C; 220/85 D; 248/37.3; 248/37.6; 24/453; 24/662

[58] Field of Search ..... 206/477, 478, 483, 493; 229/1.5 C; 248/37.3, 37.6; 215/100 R, 100 A, 101; 220/85 D; 24/453, 662

[56] References Cited

U.S. PATENT DOCUMENTS

| | | | |
|---|---|---|---|
| 1,393,574 | 10/1921 | Rohmiller | 220/85 D |
| 1,549,269 | 8/1925 | Koree et al. | 220/85 D |
| 2,175,735 | 10/1939 | Banks | 220/85 D |
| 2,654,504 | 10/1953 | Hyams | 220/85 D |
| 2,838,820 | 6/1958 | Hakanson | 24/662 |
| 3,416,200 | 12/1968 | Daddona, Jr. | 24/662 |
| 3,570,125 | 3/1971 | Hahn | 248/37.6 |
| 3,963,123 | 6/1976 | Beal | 206/477 |
| 4,170,299 | 10/1979 | Clements | 206/493 |
| 4,305,171 | 12/1981 | Pettersson | 24/662 |

FOREIGN PATENT DOCUMENTS

| | | | |
|---|---|---|---|
| 650279 | 10/1962 | Canada | 215/100 R |

*Primary Examiner*—David T. Fidei

*Attorney, Agent, or Firm*—Martin J. Spellman, Jr.

[57] ABSTRACT

This invention concerns a clip for binding a set of plastic eating utensils together. The utensils to be bound together each have a pair of substantially parallel flexible, preferably plastic cylindrical arms forming the handle thereof. The utensils are generally formed so that they may be nested together one upon the other.

1 Claim, 2 Drawing Sheets

RETAINER CLIP FOR UTENSILS

BACKGROUND OF THE INVENTION

1. Field Of The Invention

This invention concerns a clip for binding a set of plastic eating utensils together. The utensils to be bound together each have a pair of substantially parallel flexible, preferably plastic cylindrical arms forming the handle thereof. The utensils are generally formed so that they may be nested together one upon the other.

The clip of the present invention serves to releasably bind the utensils in stacked relationship and permits easy removal or addition of one or more utensils from the stack with little effort.

Plastic utensils are often considered decorator items useful for informal buffets and outdoor picnicking. While some such utensils are crudely made of cheap materials and are so inexpensive as to be considered disposable, the majority of such utensils, and particularly those for which the present invention is adapted, are of substantial size, weight and quality and finish, and are too expensive to be considered disposable.

In addition, for utensils that are used in outdoor environments, traveling picnics, barbecues etc., it is desirable that a set of utensils be provided for each party. It is extremely convenient if a complete individual full set, rather than separate piles of knives, forks, etc., be available. Oftentimes a set is rolled in napkins or put loosely on plates and this is often a great inconvenience and allows individual pieces to roll around loose and get lost. It is, therefore, desirable that an inexpensive and conveniently used retainer clip be made available that will serve to retain a full set of utensils or less than a full set of utensils together and that it be capable of being made of the same material as the utensils in order to have matching appearances for aesthetic purposes.

Therefore, the object of the present invention is to provide a retainer clip for storing the plastic eating utensils which have parallel tubes serving as the handles.

2. Prior Art

Little success has been demonstrated by the prior art in achieving the foregoing objects. One such attempt which seems to be the most closely related device of the prior art to applicant's is a set of measuring spoons which have a means for holding this set in nested fashion.

U.S. Pat. No. 3,030,812, Lutz, relates to a series of measuring spoons that are nestable, one within the other, and the arms of which are stackable one on top of the other. They have a spring inserted through the small diameter hole vertically lined in each of the handles and secured under tension to the lower most of the spoons. At the opposite end is a large diameter coil the spring which is larger than the opening on the top spoon handle. This permits individual biasing of the spoons from their nesting position and rotating away from the nest for individual use. This is only a variation. In this case the handles are not deformed at all and the spoons are never removed from the tension device or useable individually. Thus, in that device, only one spoon can be used at a time whereas with applicant's device, the utensils are designed to be used individually and the flexible retaining clip permits secured nested storage but allows removing the utensils from storage with very little effort in using them individually.

DESCRIPTION OF THE DRAWING

In the accompanying drawing which forms a part of specification of the application.

ILLUSTRATIVE SPECIFIC EMBODIMENT

Figure 1:
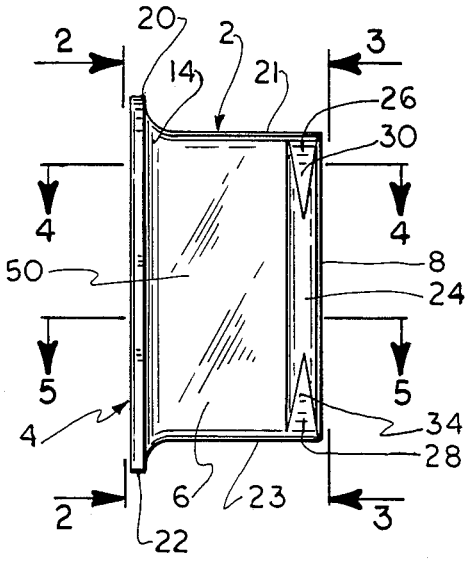
FIG. 1 is a side plan view of the present invention.

Referring to the drawing, the retainer clip of the present invention is indicated in general by the numeral 2 and comprises a base portion 4, a central body portion 6, and a bulbous top portion 8.

Figure 2:
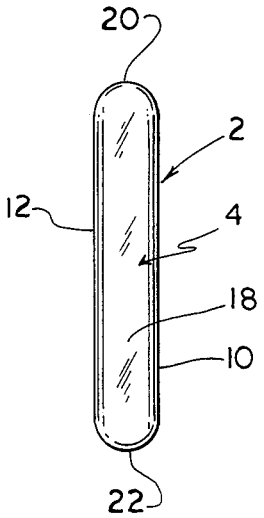
FIG. 2 is a plan view of the bottom clipped present invention taken along lines 2—2 of FIG. 1.
Figure 3:
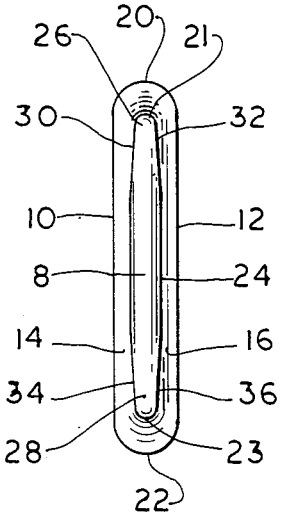
FIG. 3 is a top plan view of the device of the present taking on line 3—3 of FIG. 1.

The base 4 has laterally extending ledges 10 and 12 which are joined to the central body portion 6 in curved fillets 14 and 16. The bottom surface 18 of the base portion 4 is rounded as shown in the cross sections of FIGS. 4 and 5. The ends 20 and 22 of the base portion 4 are also rounded as shown in FIGS. 2 and 3 and extend outwardly of the edges 21 and 23 of the central body portion 6.

Figure 4:
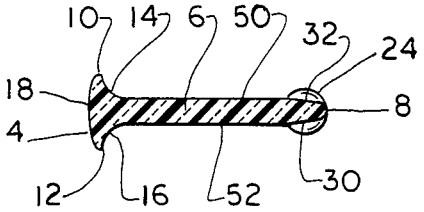
FIG. 4 is a sectional view taken along line 4—4 of FIG. 1.
Figure 5:
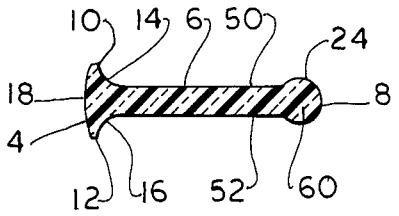
FIG. 5 is a sectional view taken along line 5—5 of FIG. 1.

The top portion 8 is bulbous in cross section in the central section 24 thereof as best shown in FIGS. 4 and 5. The end sections 26 and 24 of the top portion 8 are tapered as shown at 30, 32, 34 and 36. These end sections are also beveled inwardly slightly as shown in the cross section of FIG. 4.

Figure 6:
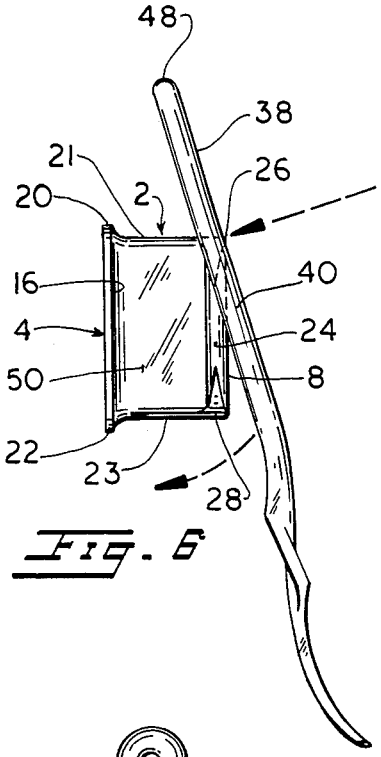
FIG. 6 is a side plan view partly fragmented, showing a fork having parallel cylindrical arms forming a handle means being over the top of the clip of the present invention.

In FIG. 6 the fork 38 is shown being placed upon the retainer clip 2. The fork 38 has a handle 40 comprising a pair of parallel cylindrical arms 42 and 44 spaced apart a distance 46 as shown, and joined at the outer ends 48.

As indicated, the utensils and clip 2 are generally formed of a slightly flexible transparent plastic which is flexible enough to allow the arms 42 and 44 to spread sufficiently to slip over the bulbous top portion 8 and then to snap in adjacent to but not pressing on the side walls 50 and 52 of the central body portion 6.

Representative utensils shown are the fork 38, teaspoon 54, soupspoon 56 and knife 58. Each has the spaced arms 42 and 44 of the fork 38. The arms for the soupspoon 56, teaspoon 54 and knife 58 are designated 42', 42'', 42''' and 44', 44'', and 44''' respectively.

Figure 7:
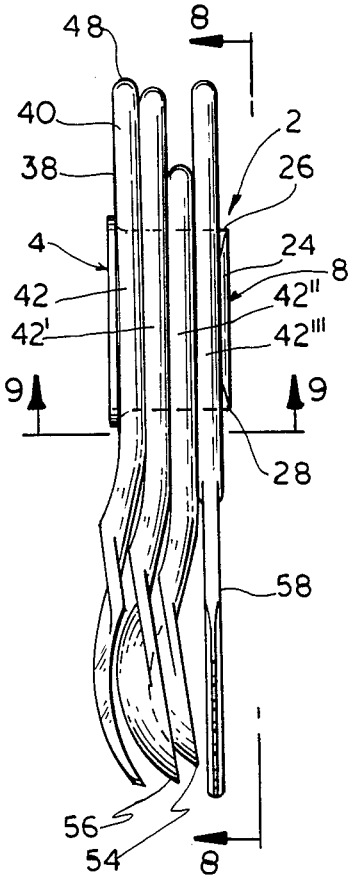
FIG. 7 is a side view showing utensils in stacked relationship mounted on the clip of the present invention.
Figure 8:
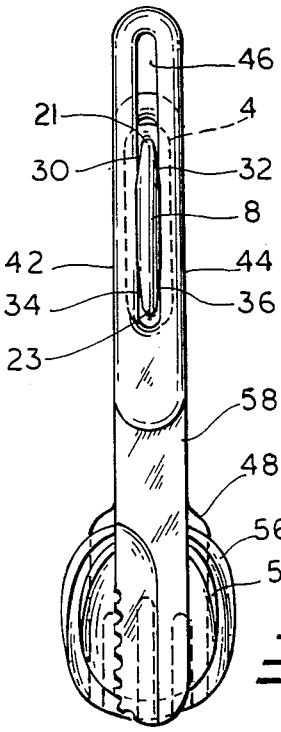
FIG. 8 is a top plan view of utensils stacked on the clip of the present invention taken along line 8—8 of FIG. 7.
Figure 9:
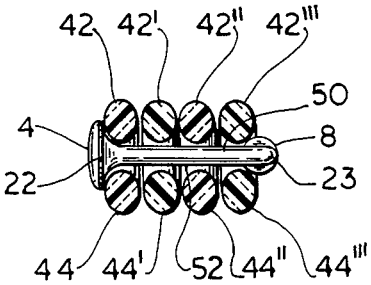
FIG. 9 is a sectional view taken along line 9—9 of FIG. 7 showing the relationship of the stacked utensils on the clip device of the present invention.

It is preferred that the utensils be slanted slightly as indicated in FIG. 6 when they are added to or removed from the clip. One or more can be added to the clip and ultimately form a stacked relationship as shown in FIGS. 7 through 9.

As indicated, both the utensils and the clip 2 of the present invention are preferably formed of transparent, colored, plastic for aesthetic purposes. The distance between the arms 42 and 44 as indicated at 48, is less than the thickness 60 of the bulbous top portion 8 when not flexed apart. With minimal force the arms 42 and 44 slip over the bulbous top portion 8 and then snap back in close relationship to the walls 50 and 52 of the central body portion 6.

The tapered and beveled portions 30, 32, 34 and 36 of the top 8 facilitate this easy spreading of the arms 42 and 44.

Although the invention has been described by reference to an illustrative embodiment, it is not intended that the novel device be limited thereby, but that modifications thereof are intended to be included as falling within the broad spirit and scope of the foregoing disclosure, and following claims.

What is claimed is:

1. A utensil retainer clip for storing table utensils in stacked relationship, each of said utensils having a handle comprising a pair of parallel cylindrical spaced apart flexible arms, said clip comprising a vertical wall central body portion, the thickness of said wall being less than the distance between said arms of said utensil handles, a base portion extending outwardly from said central body portion on both sides thereof, the width thereof being greater than the distance between said arms of said utensil handles a top portion bulbous in cross section in the central section thereof and tapered inwardly at each end thereof, said bulbous cross section being greater in thickness than the dimension of the distance between said utensil handle arms when unflexed, and less than the dimension of the distance between said arms when flexed apart from each other.

* * * * *